US006837277B2

(12) United States Patent
Troughton et al.

(10) Patent No.: US 6,837,277 B2
(45) Date of Patent: Jan. 4, 2005

(54) PAPERMAKER'S FORMING FABRIC

(75) Inventors: Brian Troughton, Herne Bay (GB); Christine Barratte, Saint Claude (FR); Oliver Baumann, Gomaringen (DE)

(73) Assignee: Weavexx Corporation, Wake Forest, NC (US)

( * ) Notice: Subject to any disclaimer, the term of this patent is extended or adjusted under 35 U.S.C. 154(b) by 183 days.

(21) Appl. No.: 10/354,928

(22) Filed: Jan. 30, 2003

(65) Prior Publication Data

US 2004/0149343 A1 Aug. 5, 2004

(51) Int. Cl.[7] ..... D03D 23/00; D03D 25/00

(52) U.S. Cl. ..... 139/383 A; 139/383 AA; 139/383 B; 139/408; 442/203; 442/205; 162/348; 162/903

(58) Field of Search ..... 139/383 A, 383 AA, 139/383 B, 408; 162/348, 903; 442/203, 205

(56) References Cited

U.S. PATENT DOCUMENTS

| | | | |
|---|---|---|---|
| 2,172,430 A | 9/1939 | Barrell | 139/383 |
| 2,554,034 A | 5/1951 | Koester et al. | 139/426 |
| 3,094,149 A | 6/1963 | Keily | 139/383 |
| 3,325,909 A | 6/1967 | Clark | 34/95 |
| 4,093,512 A | 6/1978 | Fleischer | 162/348 |
| 4,182,381 A | 1/1980 | Gisbourne | 139/383 A |
| 4,244,543 A | 1/1981 | Ericson | 248/55 |
| 4,289,173 A | 9/1981 | Miller | 139/383 A |
| 4,290,209 A | 9/1981 | Buchanan et al. | 34/123 |
| 4,414,263 A | 11/1983 | Miller et al. | 428/234 |
| 4,438,788 A | 3/1984 | Harwood | 139/383 A |
| 4,452,284 A | 6/1984 | Eckstein et al. | 139/383 A |
| 4,453,573 A | 6/1984 | Thompson | 139/383 A |

(List continued on next page.)

FOREIGN PATENT DOCUMENTS

| | | | |
|---|---|---|---|
| CA | 1115177 | 12/1981 | 139/58 |
| CN | 2-277848 | 11/1990 | D03D/15/00 |
| DE | 454 092 | 12/1927 | |

(List continued on next page.)

OTHER PUBLICATIONS

Warren, C.A., "The Importance of Yarn Properties in Wet–End Wire Construction," Seminar, The Theory of Water Removal, Dec. 12, 1979.

International Search Report for PCT Application No. PCT/US97/18627.

International Search Report for PCT Application No. PCT/US97/18629.

Rule 132 Declaration of Robert G. Wilson (Jun. 26, 1997).

PCT International Search Report for PCT/US 03/36249.

*Primary Examiner*—John J. Calvert
*Assistant Examiner*—Robert H Muromoto, Jr.
(74) *Attorney, Agent, or Firm*—Myers Bigel Sibley & Sajovec

(57) ABSTRACT

The bottom machine direction yarns and the bottom cross machine direction yarns of a triple layer fabric are interwoven in a series of repeat units in which the bottom machine direction yarns pass below multiple nonadjacent bottom cross machine direction yarns to form bottom machine direction knuckles, and in which pairs of bottom machine direction yarns separated from one another by one bottom machine direction yarn form bottom machine direction knuckle pairs under a common bottom cross machine direction yarn. Each bottom machine direction knuckle pair forms two imaginary diagonal lines with a nonadjacent bottom machine direction knuckle pair such that each bottom machine direction knuckle pair in the diagonal lines is offset by two cross machine direction yarns and one bottom machine direction yarn.

35 Claims, 8 Drawing Sheets

U.S. PATENT DOCUMENTS

| | | | | |
|---|---|---|---|---|
| 4,501,303 | A | 2/1985 | Osterberg | 139/425 A |
| 4,515,853 | A | 5/1985 | Borel | 428/257 |
| 4,529,013 | A | 7/1985 | Miller | 139/383 A |
| 4,564,052 | A | 1/1986 | Borel | 139/425 A |
| 4,592,395 | A | 6/1986 | Borel | 139/383 A |
| 4,592,396 | A | 6/1986 | Borel et al. | 139/425 |
| 4,605,585 | A | 8/1986 | Johansson | 428/224 |
| 4,611,639 | A | 9/1986 | Bugge | 139/383 A |
| 4,621,663 | A | 11/1986 | Malmendier | 139/383 A |
| 4,633,596 | A | 1/1987 | Josef | 34/116 |
| 4,636,426 | A | 1/1987 | Fleischer | 428/224 |
| 4,642,261 | A | 2/1987 | Fearnhead | 428/225 |
| 4,676,278 | A | 6/1987 | Dutt | 139/383 A |
| 4,705,601 | A | 11/1987 | Chiu | 162/348 |
| 4,709,732 | A | 12/1987 | Kinnunen | 139/383 A |
| 4,729,412 | A | 3/1988 | Bugge | 139/383 A |
| 4,731,281 | A | 3/1988 | Fleischer et al. | 428/196 |
| 4,739,803 | A | 4/1988 | Borel | 139/383 A |
| 4,755,420 | A | 7/1988 | Baker et al. | 428/222 |
| 4,759,975 | A | 7/1988 | Sutherland et al. | 428/234 |
| 4,815,499 | A | 3/1989 | Johnson | 139/383 |
| 4,815,503 | A | 3/1989 | Borel | 139/383 A |
| 4,909,284 | A | 3/1990 | Kositzke | |
| RE33,195 | E | 4/1990 | McDonald et al. | 139/425 |
| 4,934,414 | A | 6/1990 | Borel | 139/383 A |
| 4,941,514 | A | 7/1990 | Taipale | 139/383 A |
| 4,942,077 | A | 7/1990 | Wendt et al. | 428/152 |
| 4,945,952 | A | 8/1990 | Vöhringer | 139/383 |
| 4,967,805 | A | 11/1990 | Chiu et al. | 139/383 |
| 4,987,929 | A | 1/1991 | Wilson | 139/383 A |
| 4,989,647 | A | 2/1991 | Marchand | 139/383 A |
| 4,989,648 | A | 2/1991 | Tate et al. | 139/383 |
| 4,998,568 | A | 3/1991 | Vohringer | 139/383 A |
| 4,998,569 | A | 3/1991 | Tate | 139/383 A |
| 5,022,441 | A | 6/1991 | Tate et al. | 139/383 A |
| 5,025,839 | A | 6/1991 | Wright | 139/383 A |
| 5,067,526 | A | 11/1991 | Herring | 139/383 A |
| 5,074,339 | A | 12/1991 | Vohringer | 139/383 A |
| 5,084,326 | A | 1/1992 | Vohringer | 428/194 |
| 5,092,372 | A | 3/1992 | Fitzka et al. | 139/383 A |
| 5,101,866 | A | 4/1992 | Quigley | 139/383 |
| 5,116,478 | A | 5/1992 | Tate et al. | 162/358 |
| 5,152,326 | A | 10/1992 | Vohringer | 139/383 A |
| 5,158,118 | A | 10/1992 | Tate et al. | 139/383 A |
| 5,219,004 | A | 6/1993 | Chiu | 139/383 A |
| 5,228,482 | A | 7/1993 | Fleischer | 139/383 A |
| 5,238,536 | A | 8/1993 | Danby | 162/348 |
| 5,277,967 | A | 1/1994 | Zehle et al. | 139/383 A |
| 5,358,014 | A | 10/1994 | Kovar | 139/383 A |
| 5,421,374 | A | 6/1995 | Wright | 139/383 A |
| 5,421,375 | A | 6/1995 | Praetzel | 139/383 A |
| 5,429,686 | A | 7/1995 | Chiu et al. | 139/383 |
| 5,449,026 | A | 9/1995 | Lee | 139/383 A |
| 5,454,405 | A | 10/1995 | Hawes | 139/383 A |
| 5,456,293 | A | 10/1995 | Ostermayer et al. | 139/383 A |
| 5,465,764 | A | 11/1995 | Eschmann et al. | 139/383 A |
| 5,482,567 | A | 1/1996 | Barreto | 139/383 A |
| 5,487,414 | A | 1/1996 | Kuji et al. | 139/383 |
| 5,518,042 | A | 5/1996 | Wilson | 139/383 A |
| 5,520,225 | A | 5/1996 | Quigley et al. | 139/383 A |
| 5,542,455 | A | 8/1996 | Ostermayer et al. | 139/383 A |
| 5,555,917 | A | 9/1996 | Quigley | 139/383 A |
| 5,564,475 | A | 10/1996 | Wright | 139/383 A |
| 5,641,001 | A | 6/1997 | Wilson | 139/383 A |
| 5,651,394 | A | 7/1997 | Marchand | 139/383 |
| 5,709,250 | A | 1/1998 | Ward et al. | 139/383 A |
| RE35,777 | E | 4/1998 | Givin | 139/383 A |
| 5,746,257 | A | 5/1998 | Fry | 139/383 AA |
| 5,826,627 | A | 10/1998 | Seabrook et al. | 139/383 A |
| 5,857,498 | A | 1/1999 | Barreto et al. | 139/383 |
| 5,881,764 | A | 3/1999 | Ward | 139/383 A |
| 5,937,914 | A | 8/1999 | Wilson | 139/383 A |
| 5,967,195 | A * | 10/1999 | Ward | 139/383 A |
| 5,983,953 | A | 11/1999 | Wilson | 139/383 |
| 6,123,116 | A * | 9/2000 | Ward et al. | 139/383 A |
| 6,145,550 | A * | 11/2000 | Ward | 139/383 A |
| 6,148,869 | A | 11/2000 | Quigley | 139/383 |
| 6,158,478 | A * | 12/2000 | Lee et al. | 139/383 A |
| 6,179,013 | B1 * | 1/2001 | Gulya | 139/383 A |
| 6,207,598 | B1 * | 3/2001 | Lee et al. | 442/206 |
| 6,227,255 | B1 | 5/2001 | Osterberg et al. | |
| 6,244,306 | B1 * | 6/2001 | Troughton | 139/383 A |
| 6,253,796 | B1 | 7/2001 | Wilson et al. | 139/383 |
| 6,379,506 | B1 * | 4/2002 | Wilson et al. | 162/348 |
| 6,585,006 | B1 * | 7/2003 | Wilson et al. | 139/383 A |
| 6,745,797 | B2 * | 6/2004 | Troughton | 139/383 A |

FOREIGN PATENT DOCUMENTS

| | | | |
|---|---|---|---|
| DE | 33 29 740 | 3/1985 | D03D/11/00 |
| EP | 0 048 962 | 9/1981 | D03D/1/00 |
| EP | 0 158 710 | 10/1984 | D03D/1/00 |
| EP | 0 185 177 | 10/1985 | D03D/11/00 |
| EP | 0 224 276 | 12/1986 | |
| EP | 0 264 881 | 10/1987 | D21F/1/00 |
| EP | 0 269 070 | 11/1987 | D03D/11/00 |
| EP | 0 284 575 | 2/1988 | D21F/1/00 |
| EP | 0 283 181 | 3/1988 | D21F/1/00 |
| EP | 0 350 673 | 6/1989 | D21F/1/00 |
| EP | 0 048 849 A3 | 5/1990 | |
| EP | 0 048 849 A2 | 5/1990 | D21F/1/00 |
| EP | 0 672 782 | 3/1995 | D21F/1/00 |
| EP | 0 794 283 A1 | 9/1997 | D21F/1/00 |
| FR | 2 597 123 | 4/1986 | D03D/11/00 |
| FR | 8605115 | 4/1986 | |
| GB | 2157328 A | 10/1985 | D03D/1/00 |
| GB | 2245006 | 2/1991 | D03D/11/00 |
| JP | 8-158285 | 12/1994 | |
| JP | 9-41282 | 7/1995 | |
| JP | 9-87990 | 9/1995 | |
| WO | WO 86/00099 | 1/1986 | D21F/1/00 |
| WO | WO 89/09848 | 4/1989 | D03D/23/00 |
| WO | WO 93/10304 | 11/1992 | D21F/1/10 |

* cited by examiner 122 124 126 128 130 132 134 136 138 140 142

132 144

126 134 146

122 130 136 148

132 140 150

126 128 138 152

124 134 154

130 136 140 156

132 158

136
122 160

128 132 162

124 138 164

130 166

126 138 168

140
132 170

128 134 172

138
124 174

130 136 176

140
122 134 178

128
180

132 138 140

200
250 252 254 256 258 260 262 264 266 268 270 272
202

264
204

256 262 268
206

252 266
208

258 272
210

250 254 262 270
212

266
214

252 258 268
216

256 270
218

260 266
220

254
222

258 264 268
224

252 256 262 272
226

250 260 268
228

254 264
230

252 258 268
232

270
234

256 262 266
236

250 254 270
238

258 268
240

252 266
242

258 270
244

268
256 262
246

250 252 260 268
248

254 264 272

300
334
336
338
340
342
344
346
348
302

336
346
340
304

334
348
344
306

338
342
308

336
346
310

338
348
312

336
344
314

334
338
346
316

344
340
318

336
320

338
342
346
322

334
348
324

336
342
326

338
346
344
328

340
336
330

334
342
338
348
332

PAPERMAKER'S FORMING FABRIC

FIELD OF THE INVENTION

This invention relates generally to woven fabrics, and relates more specifically to woven fabrics for papermakers.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric", provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a dryer section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing a pin-seamable flap on each end or a special foldback, then reweaving these into pin-seamable loops. In a flat woven papermaker's' fabric, the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermaker's' fabric on the papermaking machine, and a direction parallel to the fabric surface and traverse to the direction of travel. Both weaving methods described hereinabove are well known in the art, and the term "endless belt" as used herein refers to belts made by either method.

Effective sheet and fiber support and an absence of wire marking are typically important considerations in papermaking, especially for the forming section of the papermaking machine, where the wet web is initially formed. Wire marking is particularly problematic in the formation of fine paper grades, as it can affect a host of paper properties, such as sheet mark, porosity, "see through" and pin holing. Wire marking is typically the result of individual cellulosic fibers being oriented within the paper web such that their ends reside within gaps between the individual threads or yarns of the forming fabric. This problem is generally addressed by providing a permeable fabric structure with a coplanar surface that allows paper fibers to bridge adjacent yarns of the fabric rather than penetrate the gaps between yarns. As used herein, "coplanar" means that the upper extremities of the yarns defining the paper-forming surface are at substantially the same elevation, such that at that level there is presented a substantially "planar" surface. Accordingly, fine paper grades intended for use in quality printing, carbonizing, cigarettes, electrical condensers, and like grades of fine paper have typically heretofore been formed on very finely woven or fine wire mesh forming fabrics.

Typically, such finely woven fabrics include at least some relatively small diameter machine direction or cross machine direction yarns. Regrettably, however, such yarns tend to be delicate, leading to a short surface life for the fabric. Moreover, the use of smaller yarns can also adversely effect the mechanical stability of the fabric (especially in terms of skew resistance, narrowing propensity and stiffness), which may negatively impact both the service life and the performance of the fabric.

To combat these problems associated with fine weaves, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paper side fabric layer and a separate, coarser machine side fabric layer. In these fabrics, which are part of a class of fabrics generally referred to as "triple layer" fabrics, the two fabric layers are typically bound together by separate stitching yarns. As double and triple layer fabrics include additional sets of yarn as compared to single layer fabrics, these fabrics typically have a higher "caliper" (i.e., they are thicker than) comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 and 5,967,195 to Ward, and U.S. Pat. No. 6,244,306 to Troughton.

Although these fabrics have performed successfully, they have some potential shortcomings. For example, the coarser CMD yarns used in the bottom layer of the fabric typically have long "floats" (segments that span multiple adjacent MD yarns in the weave pattern) that contact the papermaking machine and, accordingly, are subjected to a large degree of wear. On one hand, this is desirable, as it can protect the bottom machine direction yarns (which are forced to absorb and withstand much of the tension present in the fabric during operation); such a configuration does suggest that the cross-machine direction yarns that contact the paper machine should be wear-resistant. On the other hand, the bottom CMD yarns should not be of a size or woven in a configuration that negatively impacts papermaking. As such, a weave pattern that can improve the wear resistance of the CMD yarns while still providing acceptable papermaking properties is desirable.

SUMMARY OF THE INVENTION

The present invention is directed to papermaker's fabrics that can address some of the wear and abrasion issues noted above as well as provide a fine weave surface on the paper-forming side of the fabric. In certain embodiments of the present invention, a triple layer fabric includes a set of top machine direction yarns, a set of top cross machine direction yarns interwoven with the top machine direction yarns to form a top fabric layer, a set of bottom machine direction yarns, and a set of bottom cross machine direction yarns interwoven with the bottom machine direction yarns to form a bottom fabric layer stitched to the top fabric layer. The bottom machine direction yarns and the bottom cross machine direction yarns are interwoven in a series of repeat units in which the bottom machine direction yarns pass below multiple nonadjacent bottom cross machine direction yarns to form bottom machine direction knuckles, and in which pairs of bottom machine direction yarns separated from one another by one bottom machine direction yarn form bottom machine direction knuckle pairs under a common bottom cross machine direction yarn. Each bottom machine direction knuckle pair forms a diagonal with two imaginary diagonal lines nonadjacent bottom machine direction knuckle pair such that each bottom machine direction knuckle pair in the diagonal is offset by two cross machine direction yarns and one bottom machine direction yarn. The top and bottom fabric layers may be stitched together, for example, by conventional stitching yarns, stitching yarn pairs, pseudo-stitching yarns, and/or a self-stitching configuration.

In this configuration, the bottom machine direction knuckles of a pair tend to bow toward one another, effectively lengthening floats present on either side of these knuckles. The increased length offers more bottom CMD yarn contact area to serve as a wear surface. In addition, the presence of these two bottom MD knuckles in close proximity can exert significant force on the common bottom CMD yarn, thereby causing it to crimp substantially. As a result of this crimping force, larger (and, in turn, more wear-resistant) bottom CMD yarns can be employed.

In other embodiments according to the present invention, the papermaker's fabric discussed above includes pairs of first and second stitching yarns positioned between pairs of top CMD yarns. The first and second stitching yarns of each pair are interwoven with the top and bottom MD yarns such that, as a fiber support portion of the first stitching yarn is interweaving with the top MD yarns, a binding portion of the second stitching yarn is positioned below the top MD yarns, and such that as a fiber support portion of the second stitching yarn is interweaving with the top MD yarns, a binding portion of the first stitching yarn is positioned below the top MD yarns. The first and second stitching yarns cross each other as they pass below a transitional top MD yarn, and each of the binding portions of the first and second stitching yarns passes below at least one of the bottom MD yarns. Further, the presence of the diagonal formed by the bottom MD knuckles can provide a fabric that produces reduced marking of the paper sheet.

In other embodiments of the present invention, embodiments of the papermaker's fabrics described above may be used to make paper. A paper stock may be applied to a papermaker's fabric as described above, and moisture may be removed from the paper stock to produce paper.

DETAILED DESCRIPTION

Figure 1:
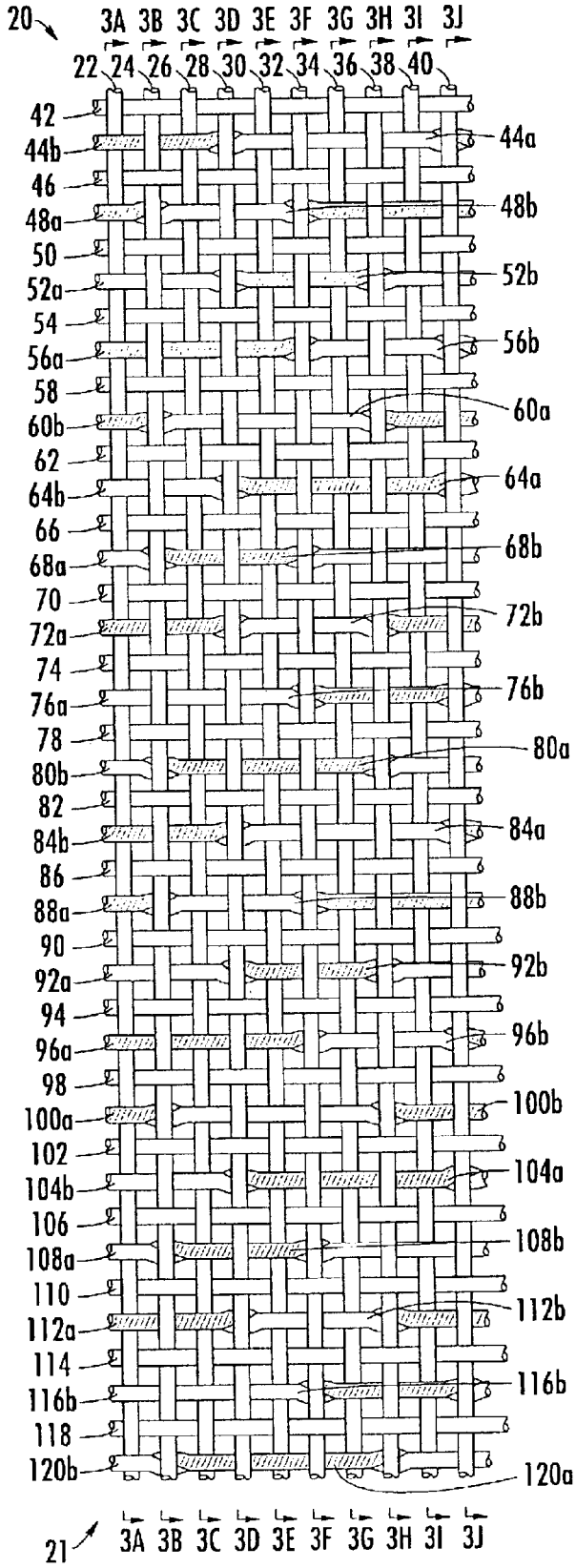
FIG. 1 is a top view of a twenty harness triple layer forming fabric according to embodiments of the present invention.

The present invention will now be described more particularly hereinafter with reference to the accompanying drawings, in which preferred embodiments of the invention are shown. The invention, however, be embodied in many different forms and is not limited to the embodiments set forth herein; rather, these embodiments are provided so that the disclosure will fully convey the scope of the invention to those skilled in the art. Like numbers refer to like components throughout. The dimensions and thicknesses for some components and layers may be exaggerated for clarity.

A twenty harness triple layer forming fabric 20 is illustrated in FIGS. 1–4, in which a single repeat unit of the fabric 20 is shown. The repeat unit of the fabric 20 includes a top layer 21 and a bottom layer 81. The top layer 21 includes ten top MD yarns 22, 24, 26, 28, 30, 32, 34, 36, 38 and 40 and twenty top CMD yarns 42, 46, 50, 54, 58, 62, 66, 70, 74, 78, 82, 86, 90, 94, 98, 102, 106, 110, 114, and 118. These are interwoven such that each top CMD yarn passes over and beneath top MD yarns in an alternating fashion, with each top MD yarn passing either over or under the top CMD yarns. For example, top CMD yarn 42 passes under top MD yarn 22, over top MD yarn 24, under top MD yarn 26, over top MD yarn 28 and so on until it passes over top MD yarn 40. Similarly, top CMD yarn 46 passes under top MD yarn 22, over top MD yarn 24, under top MD yarn 26, over top MD yarn 28 and so on until it passes over top MD yarn 40.

Figure 2:
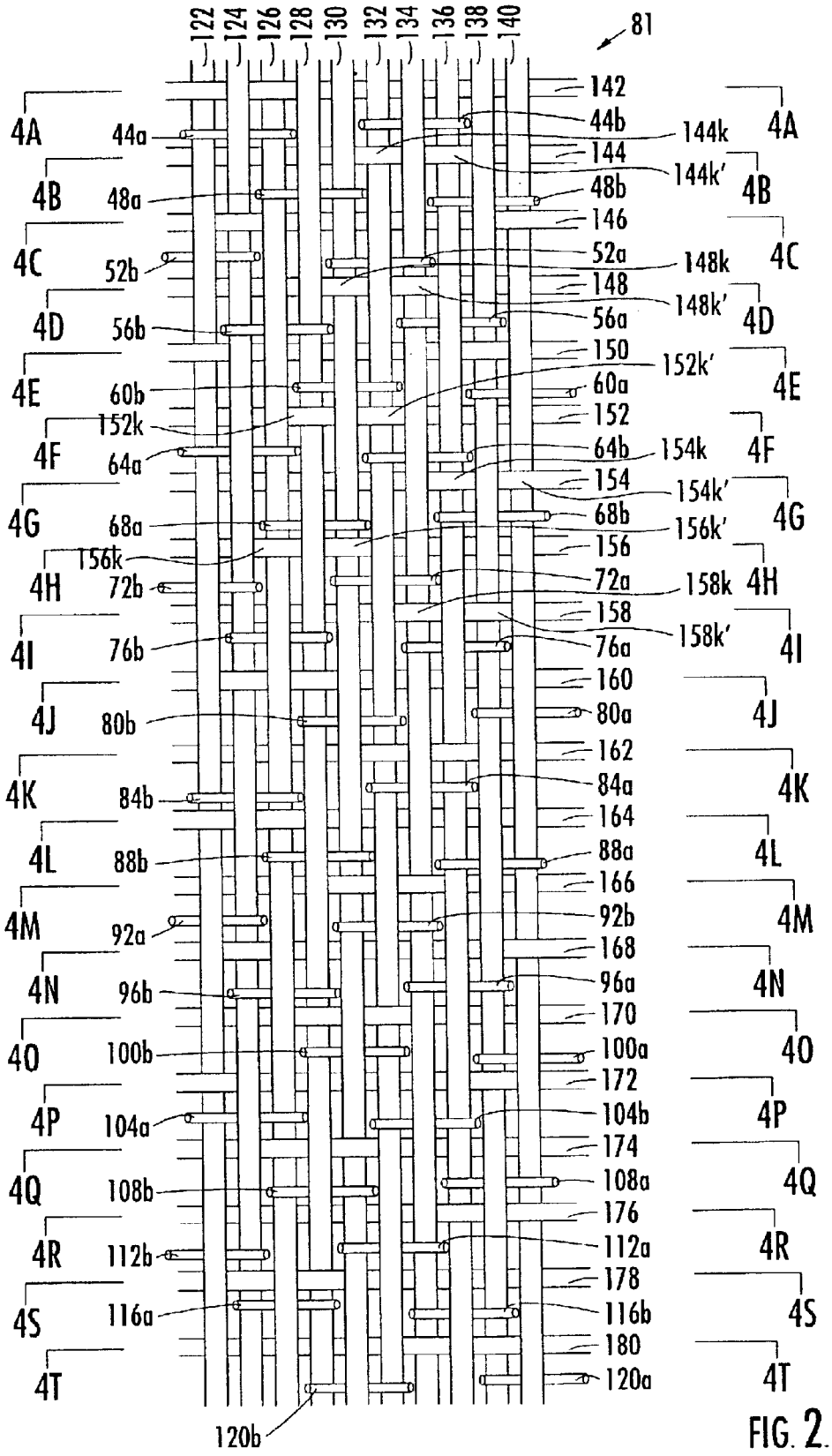
FIG. 2 is a top section view of the bottom layer the fabric of FIG. 1 with the top layer removed.
Figure 3A:
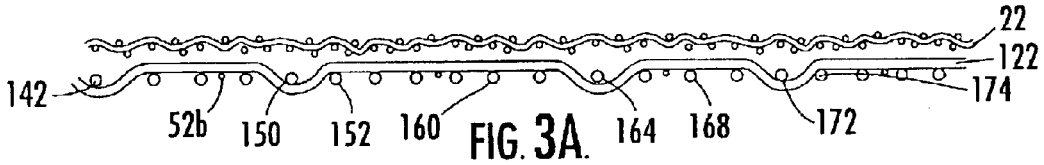
FIGS. 3A–3J are section views of the MD yarns of the fabric of FIG. 1 taken along lines 3A—3A through 3J—3J thereof.
Figure 3B:
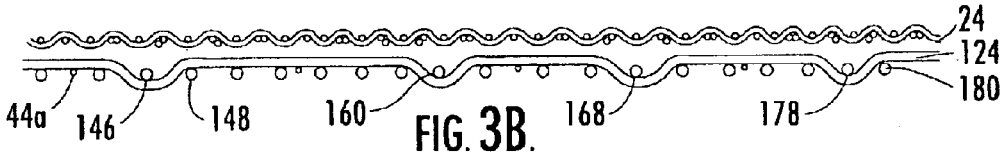
Figure 3C:
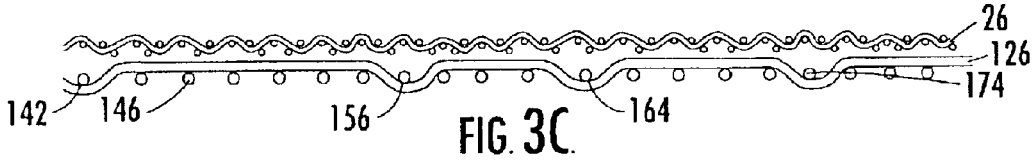
Figure 3D:
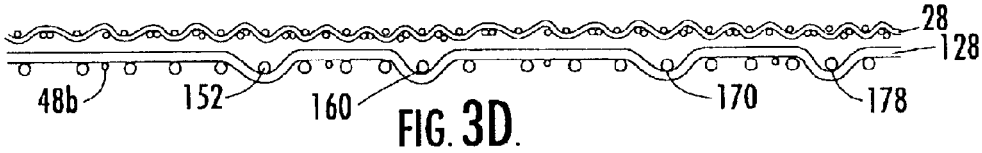
Figure 3E:
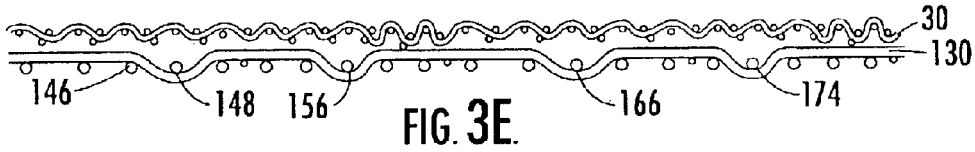
Figure 3F:
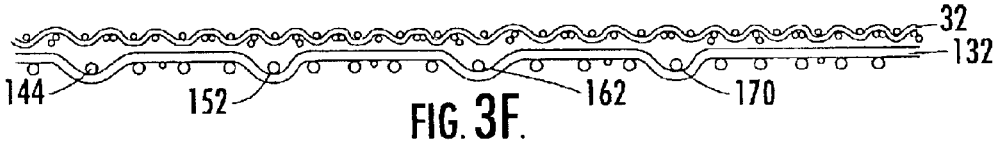
Figure 3G:
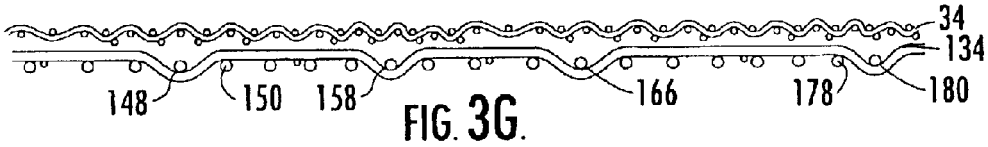
Figure 3H:
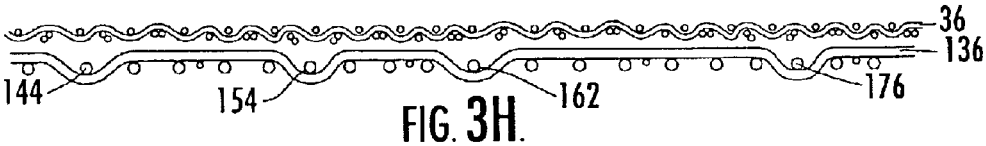
Figure 3I:
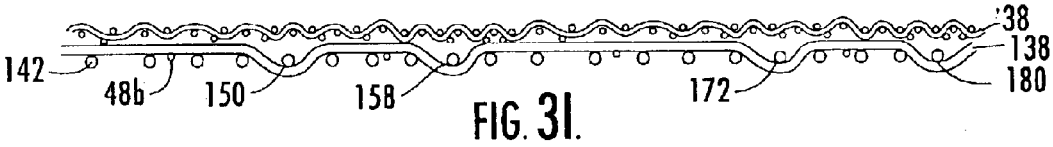
Figure 3J:
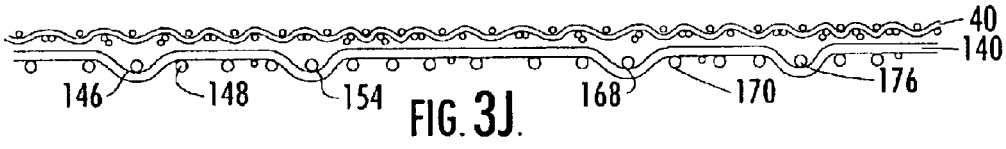

As can be seen in FIG. 2, the repeat unit of the fabric 20 also includes the bottom layer 81. The repeat unit includes ten bottom MD yarns 122, 124, 126, 128, 130, 132, 134, 136, 138, and 140, which are interwoven with twenty bottom CMD yarns 142, 144, 146, 148, 150, 152, 154, 156, 158, 160, 162, 164, 166, 168, 170, 172, 174, 176, 178, and 180. Each of the bottom MD and CMD yarns is positioned substantially directly below a corresponding top MD or CMD yarn. The interweaving pattern of the bottom layer 81 is described in greater detail below.

The top layer 21 and the bottom layer 81 also include portions of twenty stitching yarn pairs, designated herein as pairs 44*a*, 44*b*, 48*a*, 48*b*, 52*a*, 52*b*, 56*a*, 56*b*, 60*a*, 60*b*, 64*a*, 64*b*, 68*a*, 68*b*, 72*a*, 72*b*, 76*a*, 76*b*, 80*a*, 80*b*, 84*a*, 84*b*, 88*a*, 88*b*, 92*a*, 92*b*, 96*a*, 96*b*, 100*a*, 100*b*, 104*a*, 104*b*, 108*a*, 108*b*, 112*a*, 112*b*, 116*a*, 116*b*, 120*a* and 120*b*. The stitching yarns interweave with the top MD yarns and bottom MD yarns to bind the top and bottom fabric layers together. The stitching yarns form an integral part of the top layer 21 and interweave with the top MD yarns in an "over/under" pattern. Each top MD yarn that passes over the top CMD yarns also passes beneath portions of the stitching yarns, and similarly each top MD yarn that passes beneath the top CMD yarns also passes over portions of the stitching yarns to form the "over/under" pattern. For example, top MD yarn 22 passes over the CMD yarn 42, under stitching yarn 44*b*, over top CMD yarn 46, under stitching yarn 48*a* and so forth until it passes under stitching yarn 120*b*. Top MD yarn 24 passes underneath top CMD yarn 42, over stitching yarn 44*b*, under top CMD yarn 46, and so forth until it passes above the crossing point of stitching yarns 120*a* and 120*b*.

The stitching yarns are positioned in pairs between adjacent top and bottom CMD yarns; there is no bottom CMD yarn below each stitching yarn pair so that space is present for the stitching yarn to stitch. For example, stitching yarns 44*a* and 44*b* are positioned between top CMD yarns 42 and 46. When the top and bottom fabric layers 21 and 81 are joined, the top CMD yarns are positioned substantially directly above the bottom CMD yarns, such that space exists between adjacent bottom CMD yarns for the stitching yarns to stitch. That is, there is no bottom CMD yarn positioned substantially directly below the stitching yarn pairs, thereby providing a space in which the stitching yarns can stitch below a bottom CMD yarn. Of course, those skilled in this art will appreciate that the fabric 20 may have differing numbers of top and bottom CMD yarns in a repeat unit; for example, there may be 1.5, two, three or five times as many top CMD yarns as bottom CMD yarns. In addition, in some embodiments bottom CMD yarns may be present below the stitching yarn pairs; in such embodiments, it is preferred that the stitching yarns of a pair stitch on opposite sides of the underlining bottom CMD yarn.

Referring to FIG. 2, the bottom MD yarns are interwoven with the bottom CMD yarns in a pattern in which each bottom MD yarn passes under a bottom CMD yarn, over the next three adjacent bottom CMD yarns, below the next bottom CMD yarn, over the next six adjacent bottom CMD yarns, below the next bottom CMD yarn, over the next three adjacent bottom CMD yarns, below the next bottom CMD yarn, and over the next four bottom CMD yarns. For example, bottom MD yarn 122 passes under bottom CMD yarn 142, above bottom CMD yarns 144, 146, and 148, below bottom CMD yarn 150, above bottom CMD yarns 152, 154, 156, 158, 160, and 162, below bottom CMD yarn 164, above bottom CMD yarns 166, 168 and 170, below bottom CMD yarn 172, and above bottom CMD yarns 174, 176, 178 and 180. The other bottom MD yarns follow a similar "under 1/over 3/under 1/over 6/under 1/over 3/under 1/over 4" weave pattern, but each is offset in its weaving sequence from its nearest bottom MD yarn neighbors by two bottom CMD yarns. Consequently, bottom MD yarn 124 (which is adjacent bottom CMD yarn 122) passes below bottom CMD yarn 178, above bottom CMD yarns 180, 142, 144, below bottom CMD yarn 146, above bottom CMD yarns 148, 150, 152, 154, 156, and 158, below bottom CMD yarn 160, above bottom CMD yarn 162, 164, and 166, below bottom CMD yarn 168, above bottom CMD yarns 170, 172, 174, and 176. Thus, the bottom MD "knuckle" formed by bottom MD yarn 122 as it passes below bottom CMD yarn 150 is offset from the corresponding bottom "knuckle" formed by adjacent bottom MD yarn 124 as it passes below bottom CMD yarn 146 by two bottom CMD yarns.

As can be seen in FIGS. 3A–J, each of the bottom MD yarns forms four knuckles in the repeat pattern. Two pairs of the knuckles are offset from one another by four bottom CMD yarns, one pair of knuckles is offset by seven bottom CMD yarns, and another pair of knuckles is offset by five bottom CMD yarns. For example, bottom MD yarn 122 in FIG. 3A form four bottom MD knuckles at bottom CMD yarns 142, 150, 164, and 172, which are offset by from one another by four, seven, four, and five bottom CMD yarns, respectively.

Each of the bottom MD knuckles formed on the bottom surface of the bottom layer 81 by the bottom MD yarns is separated from another bottom MD yarn knuckle formed under the same bottom CMD yarn by one bottom MD yarn. For example, bottom MD yarns 122 and 126 form a pair of knuckles at bottom CMD yarn 142. Bottom MD yarns 122 and 126 are separated by bottom MD yarn 124. In this configuration, the bottom MD yarn knuckles tend to bow toward one another, resulting in an effective lengthening of the long bottom CMD yarn float (in this instance, seven bottom MD yarns long) between bottom MD yarn knuckle pairs. This effective increase in float length can improve wear of the fabric. Embodiments of this configuration are described in detail in U.S. Pat. No. 6,244,306 to Troughton, the disclosure of which is hereby incorporated by reference in its entirety.

Each of the bottom MD knuckle pairs forms two imaginary diagonal lines with a nonadjacent bottom MD knuckle pair such that each bottom MD knuckle pair in the diagonal is offset by two CMD yarns and one bottom MD yarn. For example, as seen in FIG. 2, bottom CMD yarn 144 forms a bottom MD knuckle pair 144*k* and 144*k*' at bottom MD yarns 132 and 136. The next consecutive bottom MD knuckle pair in the diagonal is formed by bottom CMD yarn 148, which forms a bottom MD knuckle pair 148*k* and 148*k*' at bottom MD yarns 130 and 134. The next consecutive bottom MD knuckle pair in the diagonal is formed at bottom CMD yarn 152, which forms a bottom MD knuckle pair 152*k* and 152*k*' at MD yarns 128 and 132, followed by a bottom MD knuckle pair formed at bottom CMD yarn 156, which forms a bottom MD knuckle pair 156*k* and 156*k*' at MD yarns 126 and 130, and so forth.

Likewise, the bottom CMD yarns separating the bottom MD knuckle pairs in the diagonal lines described above form similar imaginary diagonal lines of bottom MD knuckle pairs. For example, bottom CMD yarn 154 forms bottom MD knuckle pair 154*k* and 154*k*' at bottom MD yarns 136 and 140. The next bottom MD knuckle pair 158*k* and 158*k*' in the diagonal is formed by bottom CMD yarn 158 at bottom MD yarns 134 and 18, and so forth.

The alternating diagonal pattern described above may improve marking properties of the fabric.

The bottom CMD yarns may be grouped in adjacent pairs such that the first half of the repeat pattern in the first bottom CMD yarn in a pair follows the same pattern as the second half of the second bottom CMD yarn in the pair. For example, bottom CMD yarn 142 passes above bottom MD yarn 122, beneath bottom MD yarn 124, above bottom MD yarn 126, and beneath bottom MD yarns 128, 130, 132, 134, 136, 138, and 140. Adjacent bottom CMD yarn 144 passes above bottom MD yarn 132, beneath bottom MD yarn 134, above bottom MD yarn 136, and beneath bottom MD yarns 138, 140, 122, 124, 126, 128, and 130.

As can be seen in FIGS. 1–4 the corresponding pairs of stitching yarns interweave with the top MD yarns and bottom MD yarns in the following pattern. Each of the stitching yarns of the repeat unit can be subdivided into two portions: a fiber support portion which interweaves with the top MD yarns, and a binding portion which interweaves with a bottom MD yarn. These are separated at "transitional" top MD yarns, below which one stitching yarn of a pair crosses the other stitching yarn of the pair. The stitching yarns of each pair are interwoven relative to one another such that the fiber support portion of one yarn of the pair is positioned above the binding portion of the other yarn of the pair. The fiber support portion of the stitching yarn of each pair designated with an "a" (e.g., 44*a*, 48*a*, 52*a*) interweaves in an alternating fashion with five top MD yarns (alternately passing over three top MD yarns and under two top MD yarns), and the other stitching yarn of the pair (those designated with a "b") passes over two top MD yarns while passing below a top MD yarn positioned between those two MD yarns. In its fiber support portion, each stitching yarn passes over top MD yarns that the top CMD yarns pass beneath, and passes below top MD yarns that each top CMD yarn passes over. In this manner, the stitching yarns and top CMD form a plain weave pattern with the top MD yarns on the papermaking (i.e., top surface )(see FIG. 1).

In its binding portion, each stitching yarn passes below one bottom MD yarn in the repeat unit such that an "over 4/under 1" pattern is established by the pair of stitching yarns on the bottom surface of the fabric 20 (see FIG. 2). This configuration is discussed in greater detail in U.S. Pat. No. 5,967,195 to Ward, the disclosure of which is hereby incorporated herein by reference in its entirety. When a stitching yarn passes below a bottom MD yarn, it does so between two bottom CMD yarns that are forming bottom CMD long floats. In this position, the CMD yarns can protect the stitching yarns from contact with the paper machine and from the resultant wear.

Pairs of stitching yarns that are positioned adjacent to and on opposite sides of a top or bottom CMD yarn are interwoven with the top or bottom MD yarns such that there is an offset of two MD yarns between such stitching yarn pairs. For example, stitching yarn 44*a* passes above top MD yarns 30, 34 and 38 and below bottom MD yarn 124. Stitching yarn 48*a* passes above top MD yarns 34, 38 and 22 (with top MD yarn 22 being a continuation of the pattern on the opposite side) and below bottom MD yarn 128. Thus, stitching yarn 44*a* is offset from stitching yarn 48*a* by two top and bottom MD yarns. This same two MD yarn offset is followed for the interweaving of the other stitching yarns.

It can also be seen in FIGS. 1, 2 and 3A–J that the stitching yarns are interwoven with the top and bottom MD yarns as "reversed picks" configuration. The "reversed picks" configuration is described in detail in U.S. Pat. Nos. 5,967,195 and 6,145,550 to Ward. To summarize for the present invention, the presence of reversed picks in a double-pick-stitched triple layer fabric can be established by locating the transitional top MD yarns and determining the most predominant imaginary diagonal line formed by the transitional top MD yarns, the most predominant diagonal line being the diagonal line having the minimum number of steps between transitional top MD yarns. If the fiber support portions of successive stitch yarn pairs on one side of this diagonal are closer to each other in some cases and farther apart in others, then the fabric can have at least some "reversed picks" in the stitching yarn configuration. Although it is preferred that all of the stitching yarn pairs follow this pattern, i.e., that 50% of the stitching yarn pairs be "reversed", some benefit can be obtained by reversing only a smaller percentage (for example 25, 33 or 40%) of the stitching yarn pairs.

Fabrics having non-reversed pick stitching yarns may also be used. In addition, other stitching yarn configurations may be used, including "pseudo-stitching" yarns. In a pseudo-stitching yarn configuration, only one of the stitching yarns in a stitching yarn pair forms a knuckle with the bottom MD yarns in the repeat unit. Moreover, in some embodiments of the present invention, a "self-stitched" fabric can be used. An example of a self-stitched fabric can be found in U.S. Pat. No. RE35,777 to Givin, the disclosure of which is hereby incorporated by reference in its entirety. A self-stitched fabric is a fabric that includes a set of top MD yarns, a set of bottom MD yarns, a set of top CMD yarns, and a set of bottom CMD yarns. The top MD yarns interweave with the top CMD yarns to form a top fabric layer, and the set of bottom MD yarns interweave with the bottom CMD yarns to form a bottom fabric layer. The top MD or top CMD yarns can stitch the top and bottom fabric layers together. That is, an MD yarn from the top layer periodically interweaves with a bottom CMD yarn, and/or a CMD yarn from the top layer periodically interweaves with a bottom MD yarn, thus forming an effective stitching point. Typically, the top CMD or top MD yarns that interweave with the bottom layer to form a stitching point do not form an integrated part of the bottom fabric layer and are used in addition to the knuckles that form the pattern of the bottom layer shown in FIG. 2. Additional stitching yarns may not be necessary.

Although the illustrated embodiments employ plain weave pattern top layers, the fabrics of the present invention may also employ other top layer weave patterns; for example, twills, satins, broken twills, and the like may also be employed. Each of the bottom CMD yarns may be positioned substantially directly below a corresponding top CMD yarn. When stitching yarn pairs are used, there is typically no bottom CMD yarn positioned substantially directly below the stitching yarn pairs, thereby providing a space in which the stitching yarns can stitch below a bottom CMD yarn. Of course, those skilled in this art will appreciate that the fabric may have differing numbers of top and bottom CMD yarns in a repeat unit; for example, there may be 1.5, two or three times as many top CMD yarns as bottom CMD yarns, or there may be a CMD yarn below each stitching yarn pair.

The stitching yarns may comprise an integral portion of the top surface weave or may not. The stitching yarns can be stitched in the cross machine direction or in the machine direction of the fabric. Further, stitching yarns that are not arranged as stitching yarn pairs may also be employed in the fabrics of the present invention; examples of such stitching yarns are illustrated in U.S. Pat. No. 5,238,536 to Danby.

Those skilled in the art will appreciate that, although the illustrated fabric in FIGS. 1–4 employs ten top MD yarns and ten bottom MD yarns (i.e., they are "twenty harness fabrics"), other numbers of top and bottom MD yarns may be employed in fabrics of the present invention. For example, fabrics employing eight, or twelve top and bottom MD yarns may also be suitable for fabrics of the present invention. FIGS. 5A–J and 6A–X illustrate the bottom layer 200 of an alternative embodiment of a twenty-four harness triple layer fabric (not shown in its entirety). The bottom layer 200 can be stitched to a top layer similar to the top layer 21 described with respect to fabric 20 in FIGS. 1–4.

The bottom layer 200 includes twenty-four bottom CMD yarns 202, 204, 206, 208, 210, 212, 214, 216, 218, 220, 222, 224, 226, 228, 230, 232, 234, 236, 238, 240, 242, 244, 246, and 248 interwoven with twelve bottom MD yarns 250, 252, 254, 256, 258, 260, 262, 264, 266, 268, 270, and 272. As they interweave, each bottom MD yarn follows an "under 1/over 3/under 1/over 8/under 1/over 3/under 1/over 6" weave pattern relative to the bottom CMD yarns, with adjacent bottom MD yarns being offset from one another by two bottom CMD yarns.

Each bottom MD yarn forms four bottom MD knuckles. The four bottom MD knuckles are offset from one another by nine, seven or, in two cases, four bottom CMD yarns. For example, bottom MD yarn 250 forms knuckles at bottom CMD yarns 202, 210, 228, and 236, which are offset from one another by four, nine, four, and seven bottom CMD yarns, respectively.

Figures 4A, 4B, 4C, 4D, 4E, 4F, 4G, 4H, 4I, 4J, 4K, 4L, 4M, 4N, 4O, 4P, 4Q, 4R, 4S, 4T:
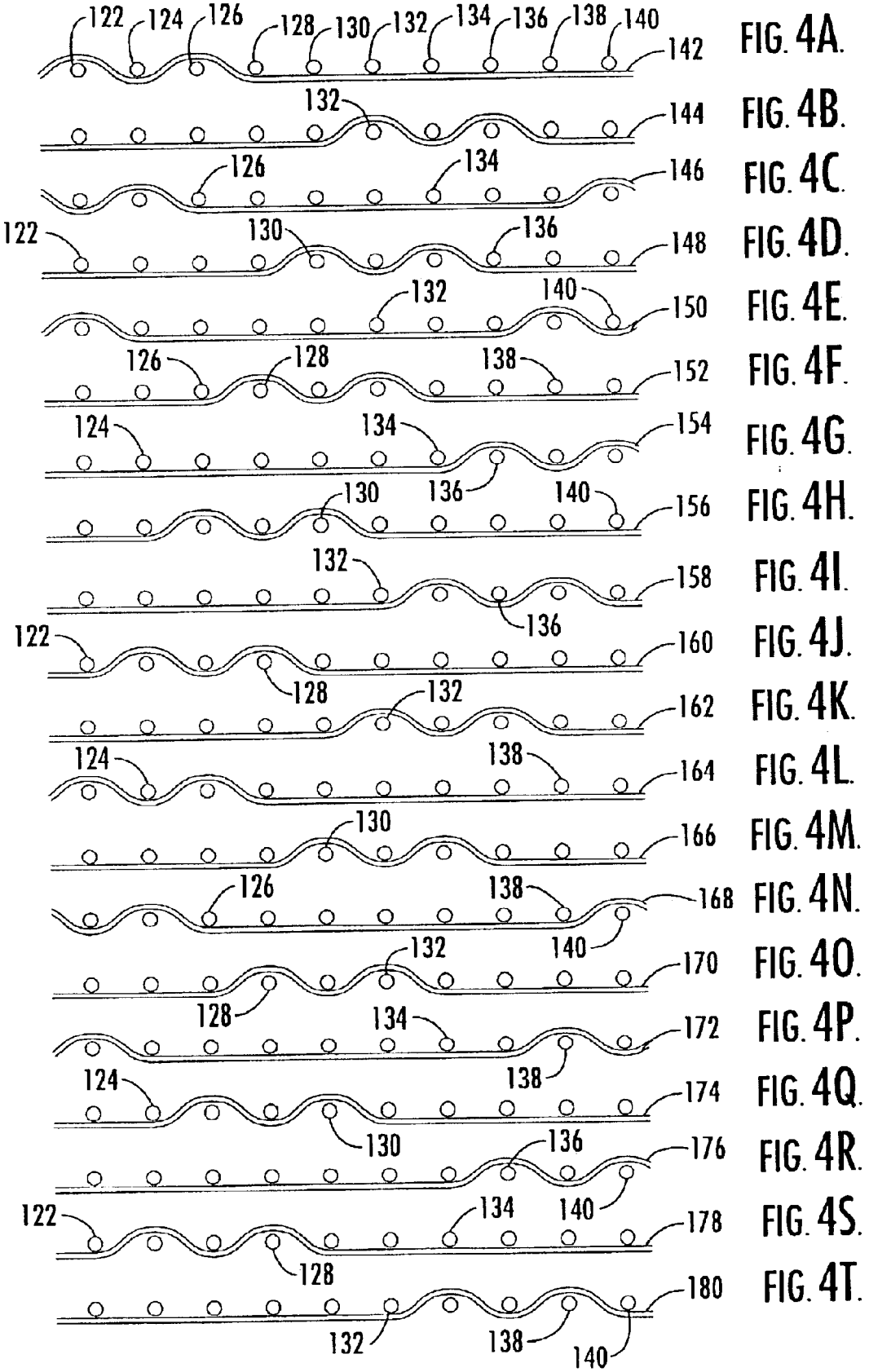
FIGS. 4A–4T are section views of the CMD yarns of the fabric of FIG. 1 taken along lines 4A—4A through 4T—4T.
Figure 5A:
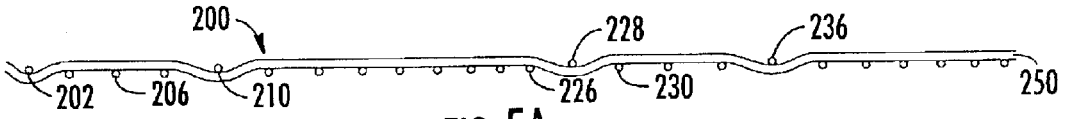
FIGS. 5A–5L are cross-sectional views of the MD yarns of a bottom layer of a twenty-four harness triple layer fabric according to embodiments of the present invention.
Figure 5B:
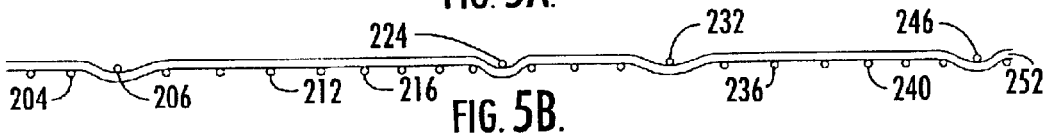
Figure 5C:
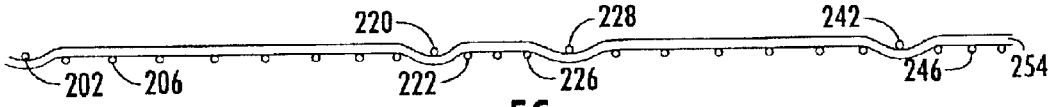
Figure 5D:
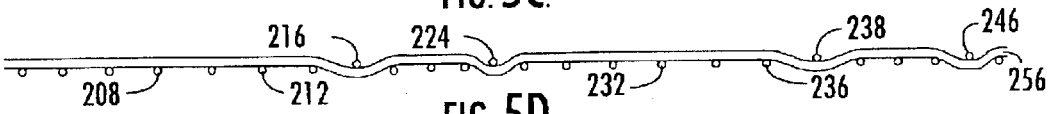
Figure 5E:
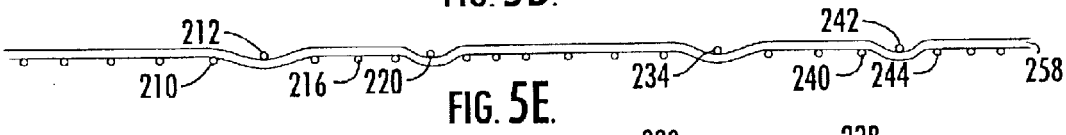
Figure 5F:
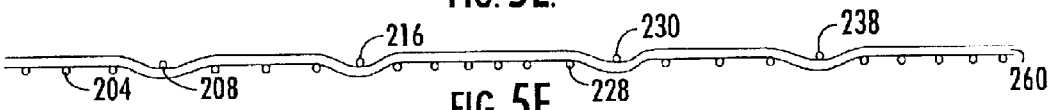
Figure 5G:
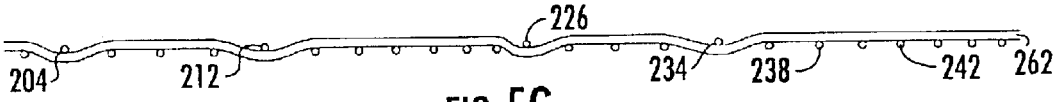
Figure 5H:
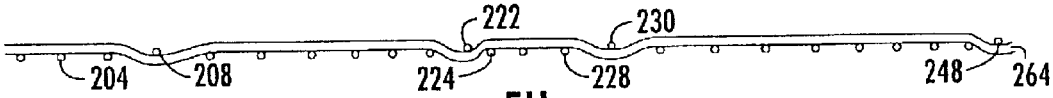
Figure 5I:
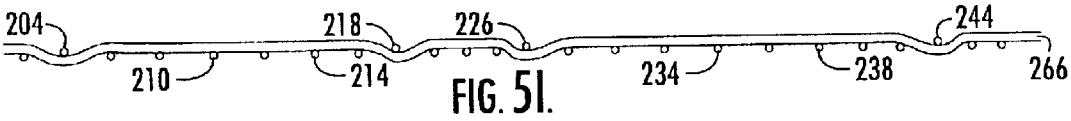
Figure 5J:
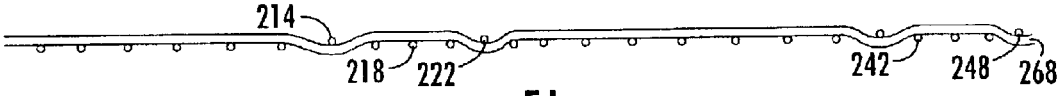
Figure 5K:
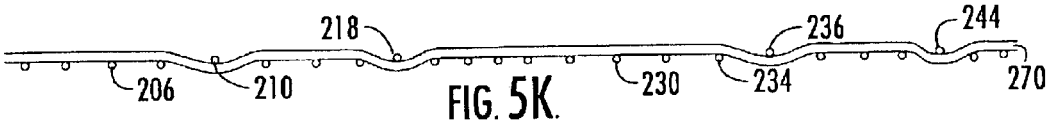
Figure 5L:
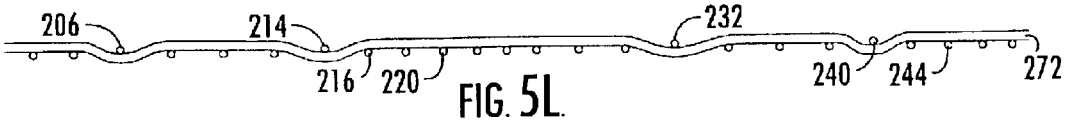
Figures 6A, 6B, 6C, 6D, 6E, 6F, 6G, 6H, 6I, 6J, 6K, 6L, 6M, 6N, 6O, 6P, 6Q, 6R, 6S, 6T, 6U, 6V, 6W, 6X:
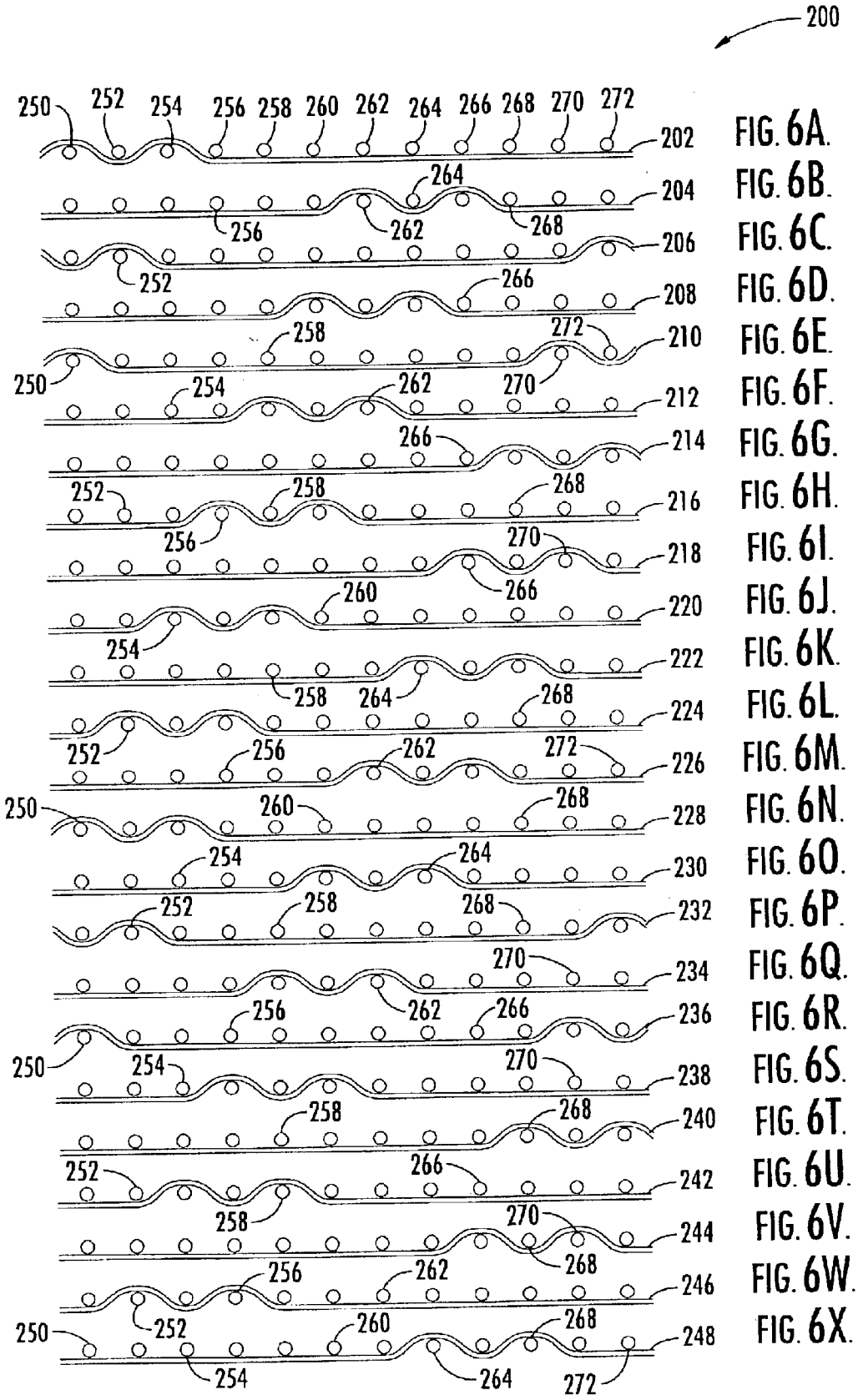
FIGS. 6A–6X are cross-sectional views of the CMD yarns of the bottom layer of the twenty-four harness triple layer fabric of FIGS. 5A–5L.

Like the fabric 20, in the bottom layer 200 bottom MD knuckle pairs are formed under a common bottom CMD yarn such that each knuckle in the pair is separated by one bottom MD yarn. Each of the bottom MD knuckle pairs form imaginary diagonal lines with a nonadjacent bottom MD knuckle pair such that each bottom MD knuckle pair in the diagonal lines is offset by two CMD yarns and one bottom MD yarn. For example, bottom CMD yarn 208 (FIG. 6D) forms a bottom MD knuckle pair at bottom MD yarns 260 (FIG. 4F) and 264 (FIG. 4H). The next consecutive bottom MD knuckle pair in the diagonal lines is formed by bottom CMD yarn 212, which forms a bottom MD knuckle pair at bottom MD yarns 258 and 262. The bottom MD knuckle pair formed at CMD yarn 212 is offset from the bottom MD knuckle pair formed at bottom CMD yarn 208 by two bottom CMD yarns and one bottom MD yarn. The next consecutive bottom MD knuckle pair in the diagonal lines is formed at bottom CMD yarn 216, which forms a bottom MD knuckle pair at MD yarns 256 and 260.

The bottom CMD yarns separating the bottom MD knuckle pairs in the diagonal described above form similar diagonal lines of bottom MD knuckle pairs. For example, bottom CMD yarn 210 forms bottom MD knuckle pair at bottom MD yarns 270 and 250. The next bottom MD knuckle pair in the diagonal lines is formed by bottom CMD yarn 214 at bottom MD yarns 272 and 268, and so forth.

As a further example, FIGS. 7A–H and 8A–P illustrate the MD yarns of a bottom layer 300 of a sixteen harness triple layer fabric (not shown in its entirety), which includes sixteen bottom CMD yarns 302, 304, 306, 308, 310, 312, 314, 316, 318, 320, 322, 324, 326, 328, 330, and 332 interwoven with eight bottom MD yarns 334, 336, 338, 340, 342, 344, 346, and 348. As they interweave, each bottom MD yarn follows an "under 1/over 3/under 1/over 4/under 1/over 3/under 1/over 2" pattern, with adjacent bottom MD yarns being offset from one another by two bottom CMD yarns.

Each bottom MD yarn forms four bottom MD knuckles in the repeat pattern. The four bottom MD knuckles are offset from one another by five, four, or three bottom CMD yarns. For example, bottom MD yarn 334 forms knuckles at bottom CMD yarns 302, 310, 320 and 328, which are offset from one another by four (in two cases), five, four, and three bottom CMD yarns, respectively.

Figure 7A:
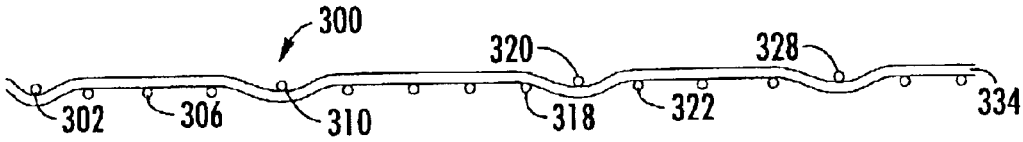
FIGS. 7A–7H are cross-sectional views of the MD yarns of a bottom layer of a sixteen harness triple layer fabric according to embodiments of the present invention.
Figure 7B:
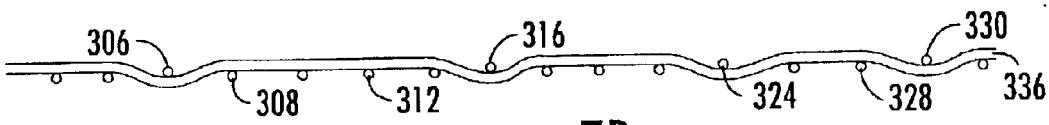
Figure 7C:
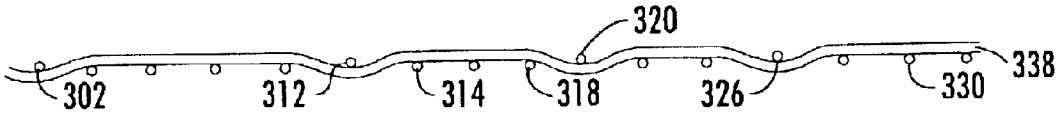
Figure 7D:
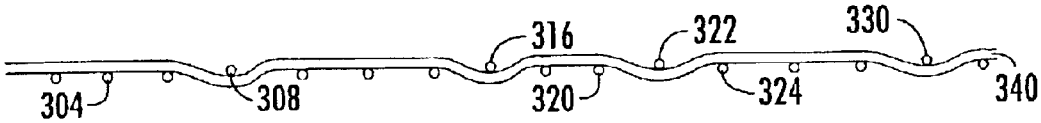
Figure 7E:
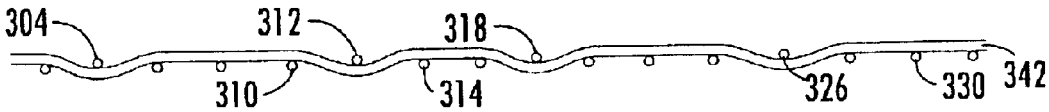
Figure 7F:
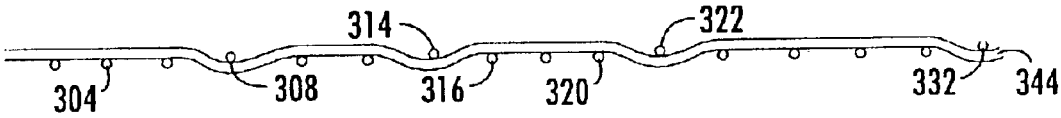
Figure 7G:
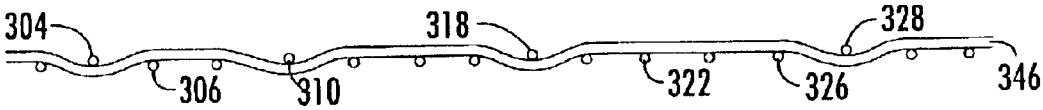
Figure 7H:
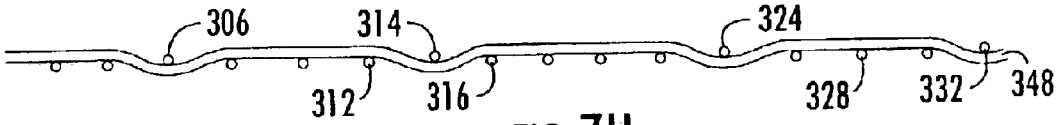
Figures 8A, 8B, 8C, 8D, 8E, 8F, 8G, 8H, 8I, 8J, 8K, 8L, 8M, 8N, 8O, 8P:
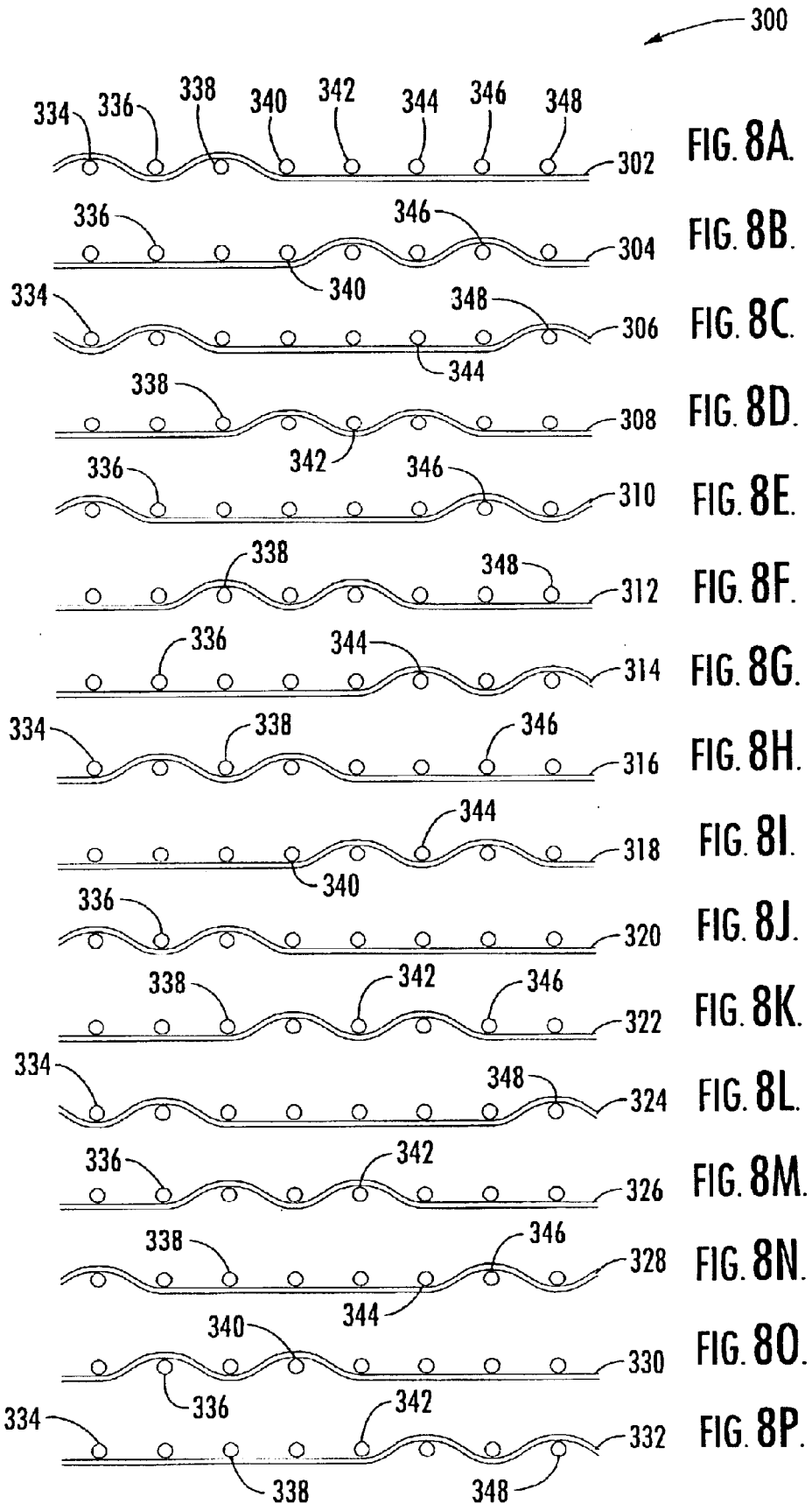
FIGS. 8A–8P are cross-sectional views of the CMD yarns of the bottom layer of the sixteen harness triple layer fabric of FIGS. 7A–7H.

Bottom MD knuckle pairs separated by one bottom MD yarn are formed under a common bottom CMD yarn. Each of the bottom MD knuckle pairs forms two imaginary diagonal lines with a nonadjacent bottom MD knuckle pair such that each bottom MD knuckle pair in the diagonal lines is offset by two CMD yarn one bottom MD yarn. For example, bottom CMD yarn 312 (FIG. 8F) forms a bottom MD knuckle pair at bottom MD yarns 338 (FIG. 7C) and 342 (FIG. 7E). The next consecutive bottom MD knuckle pair in the diagonal lines (separated by bottom CMD yarn 314) is formed by bottom CMD yarn 316, which forms a bottom MD knuckle pair at bottom MD yarns 336 and 340. The bottom CMD yarns separating the bottom MD knuckle pairs in the diagonal lines described above form similar diagonal lines of bottom MD knuckle pairs. For example, bottom CMD yarn 314 forms bottom MD knuckle pair at bottom MD yarns 344 and 348. The next bottom MD knuckle pair in the diagonal lines is formed by bottom CMD yarn 318 at bottom MD yarns 342 and 346.

It should be understood that all of the embodiments of FIGS. 4–8 will include a top layer that is stitched to the illustrated bottom layer; the top layer and stitching yarns are omitted herein for clarity.

The form of the yarns utilized in the fabrics of the present invention can vary, depending upon the desired properties of the final papermaker's fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermaker's fabric. For example, the yarns may be formed of polypropylene, polyester, aramid, nylon, or the like. The skilled artisan should select a yarn material according to the particular application of the final fabric. In particular, round monofilament yarns formed of polyester or nylon are preferred.

Yarn sizes should also be selected according to the desired papermaking properties of the fabric. As a typical example, with fine paper applications, top MD yarns have a diameter of between about 0.13 mm and 0.17 mm, top CMD yarns have a diameter of between about 0.13 mm and 0.20 mm, stitching yarns have a diameter of between about 0.11 mm and 0.15 mm, bottom MD yarns have a diameter of between about 0.17 mm and 0.25 mm, and bottom CMD yarns have a diameter of between about 0.20 mm and 0.35 mm. It should be noted that, because the fabrics of the present invention can employ larger than typical bottom CMD yarns, the ratio of diameter of bottom CMD yarn to bottom MD yarn can be from about 1.0 to about 2.5.

The foregoing embodiments are illustrative of the present invention, and are not to be construed as limiting thereof The invention is defined by the following claims, with equivalents of the claims to be included therein.

That which is claimed is:

1. A triple layer papermaker's fabric, comprising:

a set of top machine direction yarns;

a set of top cross machine direction yarns interwoven with the top machine direction yarns to form a top fabric layer;

a set of bottom machine direction yarns;

a set of bottom cross machine direction yarns interwoven with the bottom machine direction yarns to form a bottom fabric layer stitched to the top fabric layer;

wherein the bottom machine direction yarns and the bottom cross machine direction yarns are interwoven in a series of repeat units in which the bottom machine direction yarns pass below multiple nonadjacent bottom cross machine direction yarns to form bottom machine direction knuckles, and in which pairs of bottom machine direction yarns separated from one another by one bottom machine direction yarn form bottom machine direction knuckle pairs under a common bottom cross machine direction yarn; and wherein each bottom machine direction knuckle pair forms two imaginary diagonal lines with a nonadjacent bottom machine direction knuckle pair such that each bottom machine direction knuckle pair in the diagonal lines is offset by two cross machine direction yarns and one bottom machine direction yarn.

2. The triple layer fabric defined in claim 1, further comprising a set of stitching yarns interwoven with the top and bottom fabric layers.

3. The triple layer fabric defined in claim 1, wherein each bottom machine direction yarn forms four bottom machine direction knuckles.

4. The triple layer fabric defined in claim 2, wherein the top machine direction yarns, the top cross machine yarns, and the stitching yarns are interwoven to form a plain weave papermaking surface.

5. The triple layer fabric defined in claim 1, wherein the repeat unit comprises equal numbers of top cross machine direction yarns and bottom cross machine direction yarns.

6. The triple layer fabric defined in claim 2, wherein the repeat unit comprises stitching yarns arranged in pairs between adjacent top cross machine direction yarns.

7. The triple layer fabric defined in claim 2, wherein the repeat unit comprises equal numbers of top cross machine direction yarns and stitching yarn pairs.

8. The triple layer fabric defined in claim 1, wherein the bottom machine direction knuckles on each bottom machine direction yarn form two pairs of knuckles being offset by four bottom cross machine direction yarns.

9. The triple layer fabric defined in claim 8, wherein the set of bottom machine direction yarns in the repeat unit includes ten bottom machine direction yarns, and wherein the bottom machine direction knuckles on each bottom machine direction yarn form a pair of knuckles offset by seven bottom cross machine direction yarns, and a pair of knuckles offset by five bottom cross machine direction yarns.

10. The triple layer fabric defined in claim 8, wherein the set of bottom machine direction yarns in the repeat unit includes twelve bottom machine direction yarns, and wherein the bottom machine direction knuckles on each bottom machine direction yarn form a pair of knuckles offset by nine cross machine direction yarns, and a pair of bottom machine direction knuckles offset by seven cross machine direction yarns.

11. The triple layer fabric defined in claim 8, wherein the set of bottom machine direction yarns in the repeat unit includes eight bottom machine direction yarns, and wherein the bottom machine direction knuckles of each of the bottom machine direction yarns form a pair of knuckles offset by five cross machine direction yarns, and a pair of knuckles offset by three cross machine direction yarns.

12. The triple layer fabric defined in claim 1, wherein the bottom machine direction yarns have a first diameter, and the bottom cross machine direction yarns have a second diameter, and wherein the ratio between the first and second diameters is between about 1.0 and 2.5.

13. A triple layer papermaker's fabric, comprising:

a set of top machine direction yarns;

a set of top cross machine direction yarns interwoven with the top machine direction yarns to form a top fabric layer;

a set of bottom machine direction yarns;

a set of bottom cross machine direction yarns interwoven with the bottom machine direction yarns to form a bottom fabric layer;

a set of stitching yarns interwoven with the top and bottom fabric layers;

wherein the bottom machine direction yarns and the bottom cross machine direction yarns are interwoven in a series of repeat units in which the bottom machine direction yarns pass below multiple nonadjacent bottom cross machine direction yarns to form bottom machine direction knuckles, and in which pairs of bottom machine direction yarns separated from one another by one bottom machine direction yarn form bottom machine direction knuckle pairs under a common bottom cross machine direction yarn;

wherein each bottom machine direction knuckle pair forms two imaginary diagonal lines with a nonadjacent bottom machine direction knuckle pair such that each bottom machine direction knuckle pair in the diagonal lines is offset by two cross machine direction yarns and one bottom machine direction yarn; and wherein pairs of first and second stitching yarns are positioned between pairs of top cross machine direction yarns, the first and second stitching yarns of each pair being interwoven with the top and bottom machine direction yarns, such that, as a fiber support portion of the first stitching yarn is interweaving with the top machine direction yarns, a binding portion of the second stitching yarn is positioned below the top machine direction yarns, and such that as a fiber support portion of the second stitching yarn is interweaving with the top machine direction yarns, a binding portion of the first stitching yarn is positioned below the top machine direction yarns, and such that the first and second stitching yarns cross each other as they pass below a transitional top machine direction yarn, and such that each of the binding portions of the first and second stitching yarns passes below at least one of the bottom machine direction yarns.

14. The triple layer fabric defined in claim 13, wherein between 25 and 50 percent of adjacent pairs of first and second stitching yarns are interwoven as reversed picks.

15. The triple layer fabric defined in claim 13, wherein each bottom machine direction yarn forms four bottom machine direction knuckles.

16. The triple layer fabric defined in claim 13, wherein the top machine direction yarns, the top cross machine yarns, and the stitching yarns are interwoven to form a plain weave papermaking surface.

17. The triple layer fabric defined in claim 13, wherein the repeat unit comprises equal numbers of top cross machine direction yarns and bottom cross machine direction yarns.

18. The triple layer fabric defined in claim 13, wherein the repeat unit comprises equal numbers of top cross machine direction yarns and stitching yarn pairs.

19. The triple layer fabric defined in claim 13, wherein the bottom machine direction knuckles on each bottom machine direction yarn form two pairs of bottom machine direction knuckles being offset by four bottom cross machine direction yarns.

20. The triple layer fabric defined in claim 19, wherein the set of bottom machine direction yarns in the repeat unit includes ten bottom machine direction yarns, and wherein the bottom machine direction knuckles on each bottom machine direction yarn form a pair of knuckles offset by seven bottom cross machine direction yarns, and a pair of knuckles offset by five bottom cross machine direction yarns.

21. The triple layer fabric defined in claim 19, wherein the set of bottom machine direction yarns in the repeat unit includes twelve bottom machine direction yarns, and wherein the bottom machine direction knuckles on each bottom machine direction yarn form a pair of knuckles offset by nine cross machine direction yarns, and a pair of bottom machine direction knuckles offset by seven cross machine direction yarns.

22. The triple layer fabric defined in claim 19, wherein the set of bottom machine direction yarns in the repeat unit includes eight bottom machine direction yarns, and wherein the bottom machine direction knuckles of each of the bottom machine direction yarns form a pair of knuckles offset by five cross machine direction yarns, and a pair of knuckles offset by three cross machine direction yarns.

23. The triple layer fabric defined in claim 13, wherein the bottom machine direction yarns have a first diameter, and the bottom cross machine direction yarns have a second diameter, and wherein the ratio between the first and second diameters is between about 1.0 and 2.5.

24. A method of making paper, the method comprising the steps of:

(a) providing a papermaker's fabric, comprising a set of top machine direction yarns;

a set of top cross machine direction yarns interwoven with the top machine direction yarns to form a top fabric layer;

a set of bottom machine direction yarns;

a set of bottom cross machine direction yarns interwoven with the bottom machine direction yarns to form a bottom fabric layer;

a set of stitching yarns interwoven with the top and bottom fabric layers;

wherein the bottom machine direction yarns and the bottom cross machine direction yarns are interwoven in a series of repeat units in which the bottom machine direction yarns pass below multiple nonadjacent bottom cross machine direction yarns to form bottom machine direction knuckles, and in which pairs of bottom machine direction yarns separated from one another by one bottom machine direction yarn form bottom machine direction knuckle pairs under a common bottom cross machine direction yarn;

wherein each bottom machine direction knuckle pair forms two imaginary diagonal lines with a nonadjacent bottom machine direction knuckle pair such that each bottom machine direction knuckle pair in the diagonal lines is offset by two cross machine direction yarns and one bottom machine direction yarn;

(b) applying paper stock to the papermaker's fabric; and (c) removing moisture from the paper stock.

25. The method of claim 24, wherein the set of stitching yarns further comprises pairs of first and second stitching yarns are positioned between pairs of top cross machine direction yarns, the first and second stitching yarns of each pair being interwoven with the top and bottom machine direction yarns, such that, as a fiber support portion of the first stitching yarn is interweaving with the top machine direction yarns, a binding portion of the second stitching yarn is positioned below the top machine direction yarns, and such that as a fiber support portion of the second stitching yarn is interweaving with the top machine direction yarns, a binding portion of the first stitching yarn is positioned below the top machine direction yarns, and such that the first and second stitching yarns cross each other as they pass below a transitional top machine direction yarn, and such that each of the binding portions of the first and second stitching yarns passes below at least one of the bottom machine direction yarns.

26. The method of claim 25, wherein between 25 and 50 percent of adjacent pairs of first and second stitching yarns are interwoven as reversed picks.

27. The method of claim 24, wherein each bottom machine direction yarn forms four bottom machine direction knuckles.

28. The method of claim 24, wherein the top machine direction yarns, the top cross machine yarns, and the stitching yarns are interwoven to form a plain weave papermaking surface.

29. The method of claim 24, wherein the repeat unit comprises equal numbers of top cross machine direction yarns and bottom cross machine direction yarns.

30. The method of claim 24, wherein the repeat unit comprises equal numbers of top cross machine direction yarns and stitching yarn pairs.

31. The method of claim 24, wherein the bottom machine direction knuckles on each bottom machine direction yarn form two pairs of bottom machine direction knuckles, each of the two pairs being offset by four bottom cross machine direction yarns.

32. The method of claim 31, wherein the set of bottom machine direction yarns in the repeat unit includes ten bottom machine direction yarns, and wherein the bottom machine direction knuckles on each bottom machine direction yarn form a pair of knuckles offset by seven bottom cross machine direction yarns, and a pair of knuckles offset by five bottom cross machine direction yarns.

33. The method of claim 31, wherein the set of bottom machine direction yarns in the repeat unit includes twelve bottom machine direction yarns, and wherein the bottom machine direction knuckles on each bottom machine direction yarn form a pair of knuckles offset by nine cross machine direction yarns, and a pair of bottom machine direction knuckles offset by seven cross machine direction yarns.

34. The method of claim 31, wherein the set of bottom machine direction yarns in the repeat unit includes eight bottom machine direction yarns, and wherein the bottom machine direction knuckles of each of the bottom machine direction yarns form a pair of knuckles offset by five cross machine direction yarns, and a pair of knuckles offset by three cross machine direction yarns.

35. The method of laim 24, wherein the bottom machine direction yarns have a first diameter, and the bottom cross machine direction yarns have a second diameter, and wherein the ratio between the first and second diameters is between about 1.0 and 2.5.

* * * * *